US010443365B2

(12) United States Patent
Friesen et al.

(10) Patent No.: US 10,443,365 B2
(45) Date of Patent: Oct. 15, 2019

(54) SYSTEMS AND METHODS TO MONITOR THE CHARACTERISTICS OF STIMULATED SUBTERRANEAN HYDROCARBON RESOURCES UTILIZING ELECTROCHEMICAL REACTIONS WITH METALS

(71) Applicants: Cody Friesen, Fort McDowell, AZ (US); Elise Switzer, Napa, CA (US); Heath Lorzel, Mesa, AZ (US)

(72) Inventors: Cody Friesen, Fort McDowell, AZ (US); Elise Switzer, Napa, CA (US); Heath Lorzel, Mesa, AZ (US)

(73) Assignee: ARIZONA BOARD OF REGENTS ON BEHALF OF ARIZONA STATE UNIVERSITY, Scottsdale, AZ (US)

( * ) Notice: Subject to any disclaimer, the term of this patent is extended or adjusted under 35 U.S.C. 154(b) by 238 days.

(21) Appl. No.: 15/553,068

(22) PCT Filed: Feb. 23, 2016

(86) PCT No.: PCT/US2016/019040
§ 371 (c)(1),
(2) Date: Aug. 23, 2017

(87) PCT Pub. No.: WO2016/137931
PCT Pub. Date: Sep. 1, 2016

(65) Prior Publication Data

US 2018/0128090 A1 May 10, 2018

Related U.S. Application Data

(60) Provisional application No. 62/119,690, filed on Feb. 23, 2015.

(51) Int. Cl.
*E21B 43/26* (2006.01)
*E21B 47/00* (2012.01)

(52) U.S. Cl.
CPC ..... *E21B 43/26* (2013.01); *E21B 47/00* (2013.01)

(58) Field of Classification Search
None
See application file for complete search history.

(56) References Cited

U.S. PATENT DOCUMENTS 1,784,214 A 12/1930 Workman
2,799,641 A 7/1957 Bell
(Continued)

FOREIGN PATENT DOCUMENTS

EP 2212516 12/2016
WO WO 2011/044612 4/2011
(Continued)

OTHER PUBLICATIONS

International Search Report and Written Opinion issued in Corresponding International Patent Application No. PCT/US2016/019040, dated Apr. 25, 2016.
(Continued)

*Primary Examiner* — Andrew Sue-Ako
(74) *Attorney, Agent, or Firm* — Norton Rose Fulbright US LLP

(57) ABSTRACT

Methods and systems for characterizing a wellbore extending into a geologic structure comprising a reservoir of subterranean hydrocarbons comprising: providing a first fluid composition comprising a base metal into the first wellbore; wherein corrosion of the base metal in the first wellbore results in electrochemical oxidation of the base metal and electrochemical reduction of a reducible species that generates a gaseous product; providing at least one sensor in proximity to the first wellbore; and receiving a signal detected by the sensor at a monitoring unit, wherein the sensor senses a signal resulting from corrosion of the
(Continued)

base metal; wherein the signal is used to determine information relating to the characteristics of the first wellbore and extraction of hydrocarbons therefrom.

22 Claims, 3 Drawing Sheets

(56) References Cited

U.S. PATENT DOCUMENTS

| | | | | |
|---|---|---|---|---|
| 3,141,504 | A | 7/1964 | Sarapuu | |
| 3,211,220 | A | 10/1965 | Sarapuu | |
| 3,916,993 | A | 11/1975 | Katz | |
| 4,037,655 | A | 7/1977 | Carpenter | |
| 4,084,638 | A | 4/1978 | Whiting | |
| 4,199,025 | A | 4/1980 | Carpetner | |
| 4,463,805 | A | 8/1984 | Bingham | |
| 4,473,114 | A | 9/1984 | Bell et al. | |
| 4,553,592 | A | 11/1985 | Looney et al. | |
| 4,567,945 | A | 2/1986 | Segalman | |
| 4,662,438 | A | 5/1987 | Taflove et al. | |
| 5,438,169 | A | 8/1995 | Kennedy et al. | |
| 6,148,911 | A | 11/2000 | Gipson et al. | |
| 6,705,425 | B2 | 3/2004 | West | |
| 6,877,556 | B2 | 4/2005 | Wittle et al. | |
| 7,134,492 | B2 * | 11/2006 | Willberg | E21B 47/00 166/250.1 |
| 7,325,604 | B2 | 2/2008 | Wittle et al. | |
| 7,631,691 | B2 | 12/2009 | Symington et al. | |
| 8,157,981 | B2 | 4/2012 | Peters et al. | |
| 2002/0121370 | A1 | 9/2002 | Kurkjian et al. | |
| 2002/0141288 | A1 | 10/2002 | West | |
| 2003/0205083 | A1 | 11/2003 | Tubel et al. | |
| 2004/0168811 | A1 | 9/2004 | Shaw et al. | |
| 2005/0199387 | A1 | 9/2005 | Wittle et al. | |
| 2006/0118305 | A1 | 6/2006 | East, Jr. et al. | |
| 2007/0131422 | A1 | 6/2007 | Gatlin et al. | |
| 2008/0183451 | A1 | 7/2008 | Weng et al. | |
| 2008/0230219 | A1 | 9/2008 | Kaminsky | |
| 2011/0192593 | A1 | 8/2011 | Roddy et al. | |
| 2011/0203797 | A1 | 8/2011 | Alexandrov et al. | |
| 2011/0240287 | A1 | 10/2011 | Hartshorne et al. | |
| 2011/0277992 | A1 | 11/2011 | Grimes | |
| 2011/0278012 | A1 | 11/2011 | Marino et al. | |
| 2012/0273190 | A1 | 11/2012 | Thomas et al. | |
| 2012/0279713 | A1 | 11/2012 | Leon et al. | |
| 2012/0298527 | A1 | 11/2012 | James et al. | |
| 2013/0026978 | A1 | 1/2013 | Cooley et al. | |
| 2013/0105174 | A1 | 5/2013 | Noui-Mehidi | |
| 2013/0206400 | A1 | 8/2013 | Alexandrov et al. | |
| 2013/0312957 | A1 | 11/2013 | Grimes | |
| 2014/0262249 | A1 * | 9/2014 | Willberg | E21B 43/247 166/251.1 |
| 2014/0284063 | A1 | 9/2014 | Fripp et al. | |
| 2016/0040519 | A1 | 2/2016 | Friesen et al. | |
| 2016/0333254 | A1 * | 11/2016 | Friesen | E21B 43/26 |
| 2017/0284180 | A1 * | 10/2017 | Switzer | E21B 43/26 |

FOREIGN PATENT DOCUMENTS

| | | |
|---|---|---|
| WO | WO 2012/025150 | 3/2012 |
| WO | WO 2013/055851 | 4/2013 |
| WO | WO 2014/060949 | 4/2014 |
| WO | WO 2014/159676 | 10/2014 |
| WO | WO 2015/105746 | 7/2015 |
| WO | WO 2016/037094 | 3/2016 |

OTHER PUBLICATIONS

International Search Report and Written Opinion issued in International Patent Application No. PCT/US14/24699, dated Jul. 18, 2014.

International Search Report and Written Opinion issued in International Patent Application No. PCT/US2015/010116, dated Apr. 23, 2015.

International Search Report and Written Opinion issued in International Patent Application No. PCT/US2015/048615, dated Nov. 26, 2015.

Petrovic & Thomas, "Reaction of Aluminum with Water to Produce Hydrogen: A Study of Issued Related to the Use of Aluminum for On-Board Vehicular Hydrogen Storage" U.S. Department of Energy, 2008, p. 1-26.

* cited by examiner

SYSTEMS AND METHODS TO MONITOR THE CHARACTERISTICS OF STIMULATED SUBTERRANEAN HYDROCARBON RESOURCES UTILIZING ELECTROCHEMICAL REACTIONS WITH METALS

CROSS REFERENCE TO RELATED APPLICATIONS

This application is a national phase under 35 U.S.C. § 371 of International Application No. PCT/US2016/019040, filed Feb. 23, 2016, which claims the benefit of U.S. Provisional Application No. 62/119,690, filed Feb. 23, 2015, which applications are incorporated by reference herein.

BACKGROUND

1. Field of Invention

The present invention relates generally to methods and system for recovering hydrocarbons via a wellbore, and more specifically, but not by way of limitation, to methods and systems for determining information relating to the characteristics of a wellbore and extraction of hydrocarbons therefrom.

2. Description of Related Art

Hydrocarbons (e.g. petroleum, natural gas) are one of the principal energy sources utilized by current civilizations. Extraction of subterranean hydrocarbons is achieved through two principal types of processes: primary recovery and supplementary (e.g. secondary, tertiary) recovery. Primary recovery refers to hydrocarbon extraction through the natural energy prevailing in a wellbore. Supplementary recovery refers to hydrocarbon extraction through the addition of various forms of energy into a wellbore. Historically, primary recovery methods were economically satisfactory and thus hydrocarbon extraction was generally facile. As a result of worldwide oil field maturation and increasing demand, the development of supplementary recovery methods has become increasingly important. In recent years, supplementary recovery of natural gas from shale formations has increased due to advances in wellbore engineering. For example, horizontal drilling technology has significantly advanced, allowing the horizontal drilling of distances greater than a mile. In addition, advanced fracturing techniques in horizontally-drilled wellbores have greatly increased natural gas production from shale formations.

Induced fracturing of geologic structures containing subterranean hydrocarbons is conventionally performed via hydraulic fracturing. Generally, hydraulic fracturing propagates fractures within hydrocarbon-trapping formations by a pressurized fluid generated via compressors, thus creating conduits through which natural gas and petroleum may flow to the surface. It may be appreciated by those skilled in the art that extraction rates of fossil fuels resulting from hydraulic fracturing activities are related to characteristics (dimension, geometry, size, orientation, location, uncertainties, etc.) of the cracks, fissures, and fractures within the rock formations comprising the resource. Accordingly, methods such as pressure analysis and microseismic monitoring are employed in the field to probe the extent of the hydraulic fracturing process. Conventionally, geophones, hydrophones, or other sensors are provided in the proximity of the wellbore undergoing the hydraulic fracturing process. The sensors record microseismic wavefields generated during the hydraulic fracturing process and the characteristics of the fracture and wellbore are determined. In accordance with terminology used by those skilled in the art, the set of event locations and corresponding uncertainties is known as the microseismic event cloud.

Some of the major challenges with probing methods known in the art include limitations in being able to control and manipulate the activities being sensed, interpreting the information collected, and these methods provide little information as to the actual shape of the propped fracture. The information may be limited in that it is collected during and as a result of the hydraulic fracturing process which induces fractures in the rock resulting from a pressured fluid within the wellbore. U.S. Pat. No. 7,134,492 and Pub. No. US 2014/0262249 disclose use of explosive materials (e.g. a thermite mixture of metal powder and metal oxide detonated via heat or a detonator wherein the metal powder reduces the oxide of another metal) to produce a thermally-induced pressure wave used to probe the fracture geometry. These methods require a particular approach in order to control and manipulate the metal-metal redox reaction (e.g., the thermite reaction of aluminum metal and iron oxide with a particular set of reaction products).

SUMMARY OF THE INVENTION

The disclosure herein provides a system and method to probe the characteristics of fractures within the resource rock formations throughout the lifetime of the wellbore and without the need for high pressure fluids or explosive materials to induce events to be sensed with the added benefit of sustained, continuous sensing capabilities. The systems and methods described herein provide a novel approach to both have flexibility in the measurements throughout the lifetime of the well, but also the capability to manipulate the produced signal with designed chemistries.

Standard hydraulic fracturing is limited in that the accessibility of the hydrocarbon resource is primarily a function of the hydraulic pressure generated at the wellhead and associated distance from the primary wellbore through perforations (ca. 200-500 ft). The proposed methods provide an approach to extend the fracturing radius from the primary wellbore, thereby improving resource accessibility and hydrocarbon production. The developed methods are expected to facilitate extraction of subterranean hydrocarbons via a reactive chemistry capable of providing localized, sustained pressure sources. The proposed methods supplement hydrocarbon production via conventional hydraulic fracturing in a complementary approach.

Some embodiments of the present methods (e.g., for characterizing a first wellbore extending into a geologic structure comprising a reservoir of subterranean hydrocarbons) comprise: providing a first fluid composition comprising a base metal into the first wellbore; wherein corrosion of the base metal in the first wellbore results in electrochemical oxidation of the base metal and electrochemical reduction of a reducible species that generates a gaseous product; providing at least one sensor in proximity to the first wellbore; and receiving a signal detected by the sensor at a monitoring unit, wherein the sensor senses a signal resulting from corrosion of the base metal; wherein the signal is used to determine information relating to characteristics of at least one item selected from the group consisting of: the first wellbore, extraction of hydrocarbons from the first wellbore, and the electrochemical reduction.

Some embodiments of the present method (e.g., for characterizing a first wellbore extending into a geologic structure comprising a reservoir of subterranean hydrocarbons) comprise: receiving a signal from each of one or more sensors, each signal indicative of a parameter related to electrochemical oxidation of a base metal and electrochemical reduction of a reducible species that generates a gaseous product in the wellbore, at least some of the reducible species introduced into the wellbore in a first fluid composition; and deriving, from at least the signal, information about characteristics of at least one item selected from the group consisting of: the first wellbore, extraction of hydrocarbons from the first wellbore, and the electrochemical reduction; where each sensor is disposed in a position selected from the group consisting of: a first wellbore, in a second wellbore close enough to the first wellbore that the sensor can detect its respective parameter, or at the ground surface of the geologic structure.

In some embodiments of the present methods, the reducible species is water and the gaseous product is hydrogen gas.

In some embodiments of the present methods, the derived information is selected from the group consisting of: a reservoir dimension/geometry, a fracture dimension/geometry, a wellbore dimension/geometry, an azimuth, ground deformation data, seismic activity data, concentration of connate water, concentration of base metal particles, a corrosion rate, reservoir drainage volume, stimulated fracture planes generated by a hydraulic fracturing process, stimulated reservoir volume (SRV) generated by a hydraulic fracturing process, a characteristic transport rates, a characteristic relaxation time period, a derivative thereof, and/or a combination thereof.

In some embodiments of the present methods, each sensor senses energy resulting from the corroding metal, the energy being in the form of acoustic energy, electromagnetic energy, seismic energy, a derivative or a combination thereof.

In some embodiments of the present methods, each sensor provides information relating to changes in subsurface electrical properties, mechanical properties, or a combination thereof.

In some embodiments of the present methods, the at least one sensor comprise an accelerometer, a microphone, a geophone for converting ground movement into a voltage signal, a chemistry sensor, a pressure sensor, or a combination thereof.

In some embodiments of the present methods, the sensor is provided at the ground surface of the geologic structure, in a second wellbore proximal to the first wellbore, in the first wellbore or a combination thereof.

In some embodiments of the present methods, the sensing occurs simultaneously with a hydraulic fracturing process in the first wellbore.

In some embodiments of the present methods, the sensing occurs subsequent to a hydraulic fracturing process in the first wellbore.

Some embodiments of the present methods further comprise adjusting the electrochemical reduction. In some embodiments, adjusting the chemical reduction comprises changing at least one parameter selected from the group consisting of: pH of fluid in the first wellbore, concentration of the base metal in the fluid in the first wellbore, concentration of the reducible species in fluid in the first wellbore.

Some embodiments of the present methods further comprise: the step of injecting a second fluid composition differing from the first fluid composition. In some embodiments, the second fluid composition is selected to adjust the electrochemical reduction. In some embodiments, the second fluid composition initiates a second electrochemical reduction.

Some embodiments of the present methods further comprise the step of injecting a fluid composition comprising a metal differing from that of the first fluid composition, thereby providing a galvanic corrosion couple upon contact of the differing metals.

Some embodiments of the present methods further comprise the steps of sequentially injecting alternate stages of fluid compositions into the first wellbore, the stages being selected from the group comprising: injecting a fluid composition comprising base metal particles into the wellbore for a first predetermined time period; injecting a second fluid composition comprising an activating additive into the wellbore for a second predetermined time period; wherein the activating additive activates the corrosion process; and injecting a third fluid composition comprising a deactivating additive for a third predetermined time period, wherein the deactivating additive deactivates the corrosion process; wherein an alternating signal resulting from the alternating stages provides a characteristic frequency detected by a sensor; and wherein the signal is used to determine information relating to the characteristics of the first wellbore and extraction of hydrocarbons therefrom.

Some embodiments of the present methods further comprise adjusting the second fluid composition based on the derived information.

In some embodiments of the present methods, adjusting the second fluid composition comprises adjusting a concentration of the activating agent or adjusting the length of the second predetermined time period.

In some embodiments of the present methods, the second fluid composition and the third fluid composition are injected in an alternating sequence to produce an electrochemical reaction alternating in a frequency related to the second predetermined time period and the third predetermined time period. In some embodiments, the sequence is terminated based on the derived information.

Some embodiments of the present methods further comprise an idle stage wherein the corrosion process proceeds in the absence of reservoir stimulation until reaching a predetermined time period, a predetermined pressure, a predetermined signal characteristic, a user command or a combination thereof.

The term "coupled" is defined as connected, although not necessarily directly, and not necessarily mechanically; two items that are "coupled" may be unitary with each other. The terms "a" and "an" are defined as one or more unless this disclosure explicitly requires otherwise. The term "substantially" is defined as largely but not necessarily wholly what is specified (and includes what is specified; e.g., substantially 90 degrees includes 90 degrees and substantially parallel includes parallel), as understood by a person of ordinary skill in the art. In any disclosed embodiment, the terms "substantially," "approximately," and "about" may be substituted with "within [a percentage] of" what is specified, where the percentage includes 0.1, 1, 5, and 10 percent.

Further, a device or system that is configured in a certain way is configured in at least that way, but it can also be configured in other ways than those specifically described.

The terms "comprise" (and any form of comprise, such as "comprises" and "comprising"), "have" (and any form of have, such as "has" and "having"), "include" (and any form of include, such as "includes" and "including"), and "contain" (and any form of contain, such as "contains" and "containing") are open-ended linking verbs. As a result, an apparatus that "comprises," "has," "includes," or "contains" one or more elements possesses those one or more elements, but is not limited to possessing only those elements. Likewise, a method that "comprises," "has," "includes," or "contains" one or more steps possesses those one or more steps, but is not limited to possessing only those one or more steps.

Any embodiment of any of the apparatuses, systems, and methods can consist of or consist essentially of—rather than comprise/include/contain/have—any of the described steps, elements, and/or features. Thus, in any of the claims, the term "consisting of" or "consisting essentially of" can be substituted for any of the open-ended linking verbs recited above, in order to change the scope of a given claim from what it would otherwise be using the open-ended linking verb.

The feature or features of one embodiment may be applied to other embodiments, even though not described or illustrated, unless expressly prohibited by this disclosure or the nature of the embodiments.

Some details associated with the embodiments are described above and others are described below.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers. The figures are drawn to scale (unless otherwise noted), meaning the sizes of the depicted elements are accurate relative to each other for at least the embodiment depicted in the figures.

DETAILED DESCRIPTION OF ILLUSTRATIVE EMBODIMENTS

The following patent applications are hereby incorporated herein by reference in their entirety: "A system and method for facilitating subterranean hydrocarbon extraction with electrochemical processes," PCT Application No. PCT/US2014/024699 filed Mar. 12, 2014, and U.S. Provisional Patent Application No. 61/783,808 filed Mar. 14, 2013; "System and Method for Facilitating Subterranean Hydrocarbon Extraction Utilizing Electrochemical Reactions with Metals," PCT Application No. PCT/US2015/010116 filed Jan. 5, 2015, and U.S. Provisional Patent Application No. 61/925,993 filed Jan. 10, 2014; "Enhanced Recovery Methods to Supplement Hydrocarbon Production Via Conventional Hydraulic Fracturing in a Complementary Approach," PCT Application No. PCT/US2015/048615 filed Sep. 4, 2015, and U.S. Provisional Patent Application No. 62/046,280 filed Sep. 5, 2014.

Figure 1:
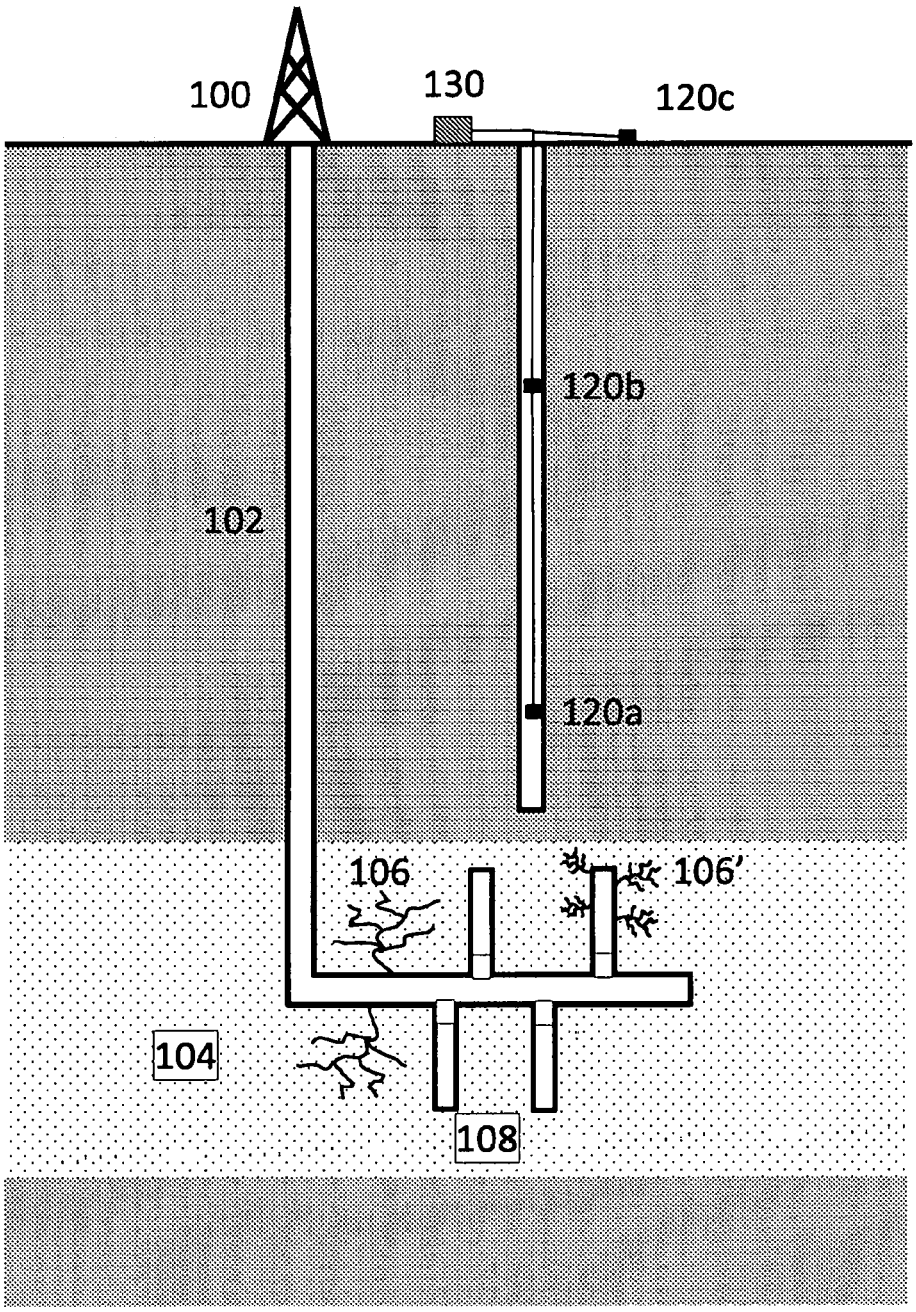
FIG. 1 illustrates a cross-sectional view of one embodiment of the present systems for facilitating extraction of subterranean hydrocarbons from a geologic structure.

Referring now to the figures, and more particularly to FIG. 1, shown therein and designated by the reference numeral 10 is a first embodiment of the present systems.

Referring now to FIG. 1, embodiments of the present methods for characterizing and monitoring a first wellbore and its associated characteristics includes the step of injecting (e.g., via one or more pumps) a first fluid composition comprising a base metal into a first wellbore 102 extending from the wellhead 100 into a geologic structure 104 comprising subterranean hydrocarbons. In some embodiments, once the base metal is positioned within wellbore 102 via the first fluid, a second fluid composition comprising an activating additive may be injected into wellbore 102. The activating additive can be configured to, in the presence of the first fluid and/or the base metal, initiate a corrosion process resulting in electrochemical oxidation of the base metal and electrochemical reduction of a reducible species to generate a gaseous product, thereby increasing subterranean pressure and inducing a subterranean pressure gradient to cause fractures 106 within the geologic structure.

In some embodiments, the reducible species may be a proton-containing species, such as, for example, connate water or water transported into the wellbore from the wellhead 100. In such embodiments, the gaseous product may comprise hydrogen gas.

In some embodiments, the activating additive may comprise an acid or acid-precursor such that the local pH proximal to the base metal is decreased, thereby accelerating the rate of corrosion. The associated corrosion process occurring at a surface of a particle of the base metal can be expressed by the anodic reaction in Equation 1 and the cathodic reaction in Equation 2:

$$M \longrightarrow M^{n+} + ne^- \tag{1}$$

$$nH_2O + ne^- \longrightarrow nOH^- + \frac{n}{2}H_2(g) \tag{2}$$

The term base metal is used herein to describe any metal that oxidizes or corrodes more easily and/or more quickly than noble or precious metals. In some embodiments, the base metal comprises one or more metals selected from the group of alkaline metals, alkaline earth metals, transition metals, and metalloids. For example, the base metal(s) can comprises sodium, calcium, zinc, indium, lead, manganese, chromium, iron, cadmium, cobalt, nickel, tin, lead, boron, silicon, and/or a combination thereof. In some embodiments, the base metal(s) can comprise aluminum, magnesium, and/or a combination thereof. In some embodiments, the base metal(s) may comprise one or more constituents of an alloy.

The electrochemical nature of the base metal and the surrounding subterranean environment will generally influence the corrosion rate and associated subterranean pressure gradient. Not to be bound by any particular theory, in many circumstances, a mixed potential of the base metal will arise according to simultaneous anodic polarization (eq. 1) and cathodic polarization (eq. 2) of the metal. For sustained corrosion of the base metal, the rate of metal oxidation (eq. 1) must be equal to the rate of reduction (eq. 2); the point at which these rates are equivalent occurs at the intersection represented by a mixed potential, or corrosion potential. This corrosion potential serves as the overvoltage reference point; the overvoltage defines the polarization of a corroding metal in terms of the potential difference between the corrosion potential and the thermodynamic equilibrium potential of the particular reactions involved in the corrosion process.

Not to be bound by any particular theory, in some embodiments, the hydrogen overvoltage may control the rate of corrosion; hydrogen overvoltage is the difference between the corrosion potential and the thermodynamic equilibrium potential of the reduction of hydrogen ions to hydrogen gas Erev as expressed in Equation 3:

$$2H^+ + 2e^- \longrightarrow H_2, \tag{3}$$

$$E^{rev}_{H2/H+} = \frac{2.3RT}{F}[\mathrm{pH} - \log(p^{1/2}_{H2})]$$

where R is the ideal gas constant, T is the temperature, and F is Faraday's constant. It can be seen from eq. 3 that Erev is dependent on the acidity (pH) and the partial pressure of hydrogen $pH_2$.

For metals with large hydrogen overvoltages (e.g., Zn, In, Pb), the actual overvoltage experienced by the metal may be dramatically smaller than that anticipated by the electrochemical series. For other base metals (e.g., Al, Mg, Na, Ca, and the like), over which water reduction is typically facile, substantial hydrogen overvoltages may be established. The hydrogen overvoltage may be varied by the concentration of activating additives and/or deactivating additives in the subterranean environment proximal to the base metal surface.

It may be appreciated that within the subterranean wellbore 102, the hydrogen overvoltage experienced by the base metal may drive the $H_2$ gas from the reaction interface at a significant pressure to produce substantial pressure gradients resulting in fractures 106. Under standard temperature-pressure conditions, that pressure may be observed as the nucleation of minuscule bubbles at the hydrophilic base metal interface (generating a bubble of radius equal to the Laplace pressure induced by its surface tension, which is augmented (smaller radius) by the hydrophilicity of the interface). These bubbles often have short lifetimes in undersaturated conditions as their small size and high pressure drives rapid diffusion into the surrounding environment.

Not to be bound by any particular theory, if the partial pressure of product hydrogen gas $pH_2$ is allowed to build in an essentially closed volume, the equilibrium potential Erev (eq. 3) approaches a value equivalent to the equilibrium potential of eq. 1, meaning no net reaction of metal ions (i.e., no further corrosion). For example, in the case of aluminum as the base metal, these pressures can be tens of thousands of psi (assuming 50 C subterranean temperatures).

In some embodiments, the base metal particles are configured to have a large surface area (i.e., a surface area larger than that of spheres with similar maximum transverse dimensions), thereby accelerating the corrosion reaction relative to particles with smaller surface areas. For example, in some embodiments, particles can be in a physical form having a ratio of surface area to volume and/or a high ratio (e.g., of 3:1 or greater) of surface area to transverse dimension (e.g., a particle with a maximum transverse dimension of 1 micron can be configured to have a surface area of 3 microns squared, or greater). The base metal may, for example, be in the form of a powder, flakes, and/or any other particle shape, or a combination thereof. In some embodiments, the aggregate (average) transverse dimension of the particles may be between 1 micron and 1 millimeters (e.g., less than any one of, or between any two of: 0.001 mm, 0.005 mm, 0.01 mm, 0.05 mm, 0.1 mm, 0.5 mm, and/or 1 mm), or may range from 1 micron to 1 mm. For example, in initial fracturing ("fracking") operations, the base metal may have an aggregate transverse dimension of up to 0.1 mm, and/or in operations to open or maintain existing fractures, the base metal may have an aggregate transverse dimension of greater than 0.1 mm. As a non-limiting example, base metal particles with a an aggregate transverse dimension of 100 microns or smaller may be positioned within a 15 cm diameter wellbore at a 50% filling factor (50% of volume of bore occupied by base metal particles, or a 1:1 ratio of fluid:base metal in a section of wellbore that is substantially filled); assuming a corrosion current of 1 mA/cm2, the current produced would approach 5,000 amperes per meter length of bore. This represents a significant amount of energy which can be strategically situated within the wellbore to facilitate hydrocarbon production and/or provide a detectable signal.

In some embodiments, the first fluid composition comprises a surface passivating additive such that the surface of the base metal is at least initially protected from corrosion, such as, for example during shipping and/or during transport downbore. In some embodiments, the surface passivating additive may comprise an anion. For example, the surface passivating additive may comprise one or more components selected from the group of sulfates, phosphates, nitrites, chromates, phosphonates, molybdates, or a combination thereof. In some embodiments, the metal may have characteristic native oxides which provide a surface passivation function.

In some embodiments, the activating additive may comprise one or more of an acid or an acid precursor (e.g., sulfuric acid, glycolic acid, carboxylic acid), a halide ion, or a combination thereof. In pH-neutral waters, the anodic corrosion of some metals (e.g., aluminum, magnesium, zinc) may develop enough energy to split water directly (eq. 2). In some embodiments, the activating additive may decrease the pH proximal to the base metal. Under acidic conditions, the corrosion process may initiate and/or corrosion rates may substantially increase. The primary requirement in most, if not all, embodiments is that the activating additive increase the rate of corrosion. For example, hydrochloric acid may be injected into the wellbore to increase the rate of corrosion of the downbore base metal. In some embodiments, the activating additive decreases the hydrogen overvoltage of the base metal, thereby facilitating higher corrosion rates. In other embodiments, the activating additive may comprise a base or a base precursor, so long as the rate of corrosion is increased.

In some embodiments (e.g., those in which the base metal particulates include a passivating native oxide film), the activating additive is configured to disrupt the passive oxide film (e.g., localized breakdown of a passivating oxide film by anions, such as, for example chloride ions). Not to be bound by any particular theory, such anions may induce localized dissolution of the passive oxide of the base metal at weaker discontinuities (e.g. grain boundary, dislocation, inclusion, etc.) and thereby expose the underlying base metal.

The disclosed systems and methods probe the characteristics of fractures within the resource rock formations throughout the lifetime of the wellbore. The method comprises the step of providing a sensor or system of sensors in proximity to the first wellbore. FIG. 1 depicts a plurality of sensor located within a second wellbore 120*a* and 120*b* and a sensor at the ground surface 120*c*. The sensors may be provided in any suitable configuration and location including at the ground surface of the geologic structure, in a second wellbore proximal to the first wellbore, in the first wellbore or a combination thereof. The only requirement is that the sensors are proximal enough to the corrosion events that a resultant signal may be detected.

In some embodiments, the sensor detects events relating to events and/or vibrations produced artificially by the presence of corroding base metals and/or induced seismic events (e.g. induced pressures resulting from corroding base metal) related to the evolution of a gaseous corrosion product through sensing of acoustic energy, electromagnetic energy, seismic energy or a combination thereof. Not to be bound by any particular theory, but transmission and reflection of electromagnetic energy may be detectably affected at boundaries where subsurface electrical properties change; transmission and reflection of acoustic energy may be detectably affected by changes in acoustic impedance of subsurface formations and cracks; and, transmission and reflection of seismic energy may be detectably affected where subsurface mechanical properties change.

In some embodiments, the systems and methods disclosed herein relate to sensing of the gaseous product of the corrosion reaction of the base metal in order to probe characteristic properties of the hydrocarbon reservoir into which the wellbore extends. The corrosion reaction results in a phase change i.e. production of gas from liquid/solid reaction characterized by a net increase in volume due to production of gaseous product. Those skilled in the art may estimate the amount of gaseous product produced and resulting pressures via Faraday's law, ideal gas law and/or non-ideal gas law. For example, magnesium may corrode according to the following equations (4) and (5):

$$Mg \rightarrow Mg^{2+} + 2e^{-} E_0 = -2.4V \text{ VS NHE} \quad (4)$$

$$2H_2O + 2e^{-} \rightarrow 2OH^{-} + H_2(g) E^0 = -0.83V \text{ VS NHE} \quad (5)$$

According to equations 4 and 5, every mole of magnesium consumed produces a mole of hydrogen gas $H_2$. So, for example, the mass of magnesium powder mMg has the potential to produce hydrogen pressures $PH_2$ according to equation (6):

$$P_{H2} \rightarrow \frac{RT}{V} \frac{m_{Mg}}{MW_{Mg}} \quad (6)$$

where R is the ideal gas constant, T is the temperature, V is the reaction volume, and $MW_{Mg}$ is the molecular weight of magnesium. The metal ions $M^{n+}$ may further combine with product hydroxide to form metal hydroxides, for example according to $Mg^{2+} + 2\ OH^{-} \rightarrow Mg(OH)_2$. It should be appreciated then, that in this embodiment, one is sensing the production of gaseous product of the corrosion reaction as opposed to a thermally-induced pressure gradient resulting from a combustion or explosive reaction. Accordingly, it may further be appreciated that the systems and methods described herein provide an opportunity to sense sustained, continuous pressures as opposed to an explosion event. The systems and methods described herein provide a novel approach to both have flexibility in the measurements throughout the lifetime of the well, but also the capability to manipulate the produced signal e.g. sustained pressures, alternating pressures and so on, through designed chemistries in view of electrochemical properties.

It may be appreciated that previous methods for sensing well characteristics e.g. fracture geometry with the use of explosive materials (e.g. a thermite mixture of metal powder and metal oxide detonated via heat or a detonator wherein the metal powder reduces the oxide of another metal) produce a thermally-induced pressure wave dissipating into the surrounding rock. These reactions are not characterized by a phase change i.e. gaseous product production or net pressure change.

The systems and methods described herein may employ both passive sensing (e.g. listening for sound wave generated by the activity and/or its propagation) and active sensing (e.g. emission of pulses and listening for echoes resulting from interaction with the active event). For example, acoustic waves and echoes may be used to pinpoint the location of the activity. Additionally, electromagnetic radiation in the radio spectrum (e.g. microwave band UHR/VHF frequencies) may be employed to measure the activity of the corroding metal, changes in material properties, voids, cracks and so on. Any suitable frequency may be employed, however it may be appreciated to those skilled in the art that higher frequencies may provide improved resolution with the trade-off being penetration depth.

The disclosed system and method further comprise the step of receiving a signal detected by the sensor at a monitoring unit 130 which is operatively coupled (e.g. wired and/or wireless), wherein the sensor senses a signal resulting from corrosion of the base metal. The monitoring unit can comprise an appropriately programmed computer including, for example, memory (e.g., non-volatile memory and/or volatile memory), instructions stored in the memory for performing the functions described in this disclosure, and a controller (e.g., processor, FPGA for field processing gate array, and/or the like) configured to execute the specially programmed instructions from the memory. The monitoring unit can be configured to use the signal to determine information relating to the characteristics of the first wellbore and extraction of hydrocarbons therefrom. The information may be a reservoir dimension/geometry, a fracture dimension/geometry, a wellbore dimension/geometry, a fracture azimuth, ground deformation data, seismic activity data, concentration of connate water, concentration of base metal particles, a corrosion rate, reservoir drainage volume, stimulated fracture planes generated by a hydraulic fracturing process, stimulated reservoir volume (SRV) generated by a hydraulic fracturing process, a derivative or a combination thereof.

It should be appreciated by those skilled in the art reading this disclosure that surface and/or downhole monitoring techniques may be employed. In embodiments related to downhole monitoring, a sensor may be provided in boreholes close to the source which minimizes signal attenuation and background noise. Small-magnitude seismicity may then be detected to determine the location of the seismic and/or corrosion events.

Various methods known by those skilled in the art may employed including use of geophone-array geometry and velocity models, introduction of a detection bias, provision of offset observation wells, hodogram three-component (3-C) sensors, triangulation schemes using arrival times of P- and/or S-waves at multiple stations, Kirchoff migration and/or semblance techniques using measurements of specific phases, microseismic mapping employing waveform correlation techniques, numerical modeling and so on.

The disclosed systems and methods may be employed immediately preceding, during and/or after active hydraulic fracturing actions. For example, sensing may be performed during hydraulic fracturing process, after fracturing when the fracture is maintained open and pressurized, and/or when the fracture is closed or 'propped' by proppant particles. Furthermore, these systems and methods may be employed for continuous reservoir monitoring.

The systems and methods described herein provide a novel approach to have both flexibility in the measurements throughout the lifetime of the well, but also the capability to manipulate the produced signal with designed chemistries.

The properties of base metal in relation to its surrounding environment may be engineered to produce a desired detectable signal. A Pourbaix diagram for the particular base metal may be used to inform on the conditions of pH (without external applied potential) under which the base metal does note corrode (immunity) or reacts to form specific oxides or complex ions. For example, one may use a suitable test to inform the downbore environment for total dissolved solids, pH, ions, etc. and with this knowledge consult Pourbaix diagrams of the base metal in the first fluid composition to determine its relative corrosion rate. For example, if a downbore environment is characterized as having a high pH, one may select aluminum as the base metal given the corrosion rate of aluminum accelerates at high pH as opposed to magnesium which is characterized as having a lower corrosion rate at high pH.

In addition to consulting Pourbaix diagrams, knowledge of the presence of specific anions downbore (e.g. $Ca^{2+}$, $Cl^{-}$, $SO_4^{2+}$ ions) may be used to further inform the relative corrosion rate of the base metal. For example, calcium ions may be provided and/or already present in the wellbore to arrest the corrosion process, thereby acting as a deactivating additive. As another example, chloride ions may be provided and/or already present in the wellbore to accelerate the corrosion process, thereby acting as an activating additive.

In some embodiments, alternate stages of fluid compositions may be sequentially injected into the first wellbore to produce an alternating signal resulting from the alternating stages. This method may provide a characteristic frequency detected by the sensor. For example, the steps may include injecting a fluid composition comprising base metal particles e.g. aluminum into the wellbore for a first predetermined time period. Subsequently, a second fluid composition comprising an activating additive e.g. an aqueous base to push pH>8 and/or a concentration of chloride ions is injected into the wellbore for a second predetermined time period. The first fluid and second fluid may then be alternatingly be injected in a sequence to produce an electrochemical reaction alternating in a frequency related to the first predetermined time period and the second predetermined time period. In another embodiment, a third fluid composition comprising a deactivating additive e.g. calcium ions, nitrite ions, water and/or an aqueous acid may alternatingly be injected into the wellbore for a third predetermined time period.

As another example wherein alternate stages of fluid compositions are sequentially injected to produce an alternating signal, a first fluid composition may comprise base metal particles, a second fluid composition may comprise water and a third fluid composition may comprise an activator. The first fluid composition may be injected first, followed by the second fluid composition, and then the third fluid composition. In some embodiments, the second fluid composition and the third fluid composition may then be injected in an alternating manner such that the first fluid composition is injected once at the outset of the process.

In some embodiments, the corrosion reaction will be allowed to proceed for a time period such that gaseous products builds and the reaction rate significantly decreases. This may then be followed by injection of an activating species and/or water.

In some embodiments, a fourth fluid composition comprising a metal differing from that of the first fluid composition may be injected into the wellbore, thereby providing a galvanic corrosion couple. Those skilled in the electrochemical arts may select the two metals based on the electrochemical series, Pourbaix diagrams and/or kinetic characteristics of the metals. For example, the fourth fluid composition may be injected subsequent to the first fluid composition and the corrosion reaction may commence once the two metals are contacted.

In some embodiments, a fluid composition may comprise an oxidant e.g. ammonium persulfate which is injected subsequent to the first fluid composition comprising a base metal, thereby oxidizing the metal particles.

In some embodiments, it may be desirable to measure characteristic transport rates of the wellbore. For example, characteristic relaxation time periods and/or characteristic transport kinetics out of the stimulated reservoir volume (SRV) may be determined. For example, a fluid composition comprising an activator or oxidant (e.g. ammonium persulfate) may first be injected deep into the formation. Subsequently, a fluid composition comprising base metal particles may be injected into the formation at a more shallow position than the activator or oxidant. One may then decrease the wellbore pressure and measure the timescale to reaction.

Figure 2:
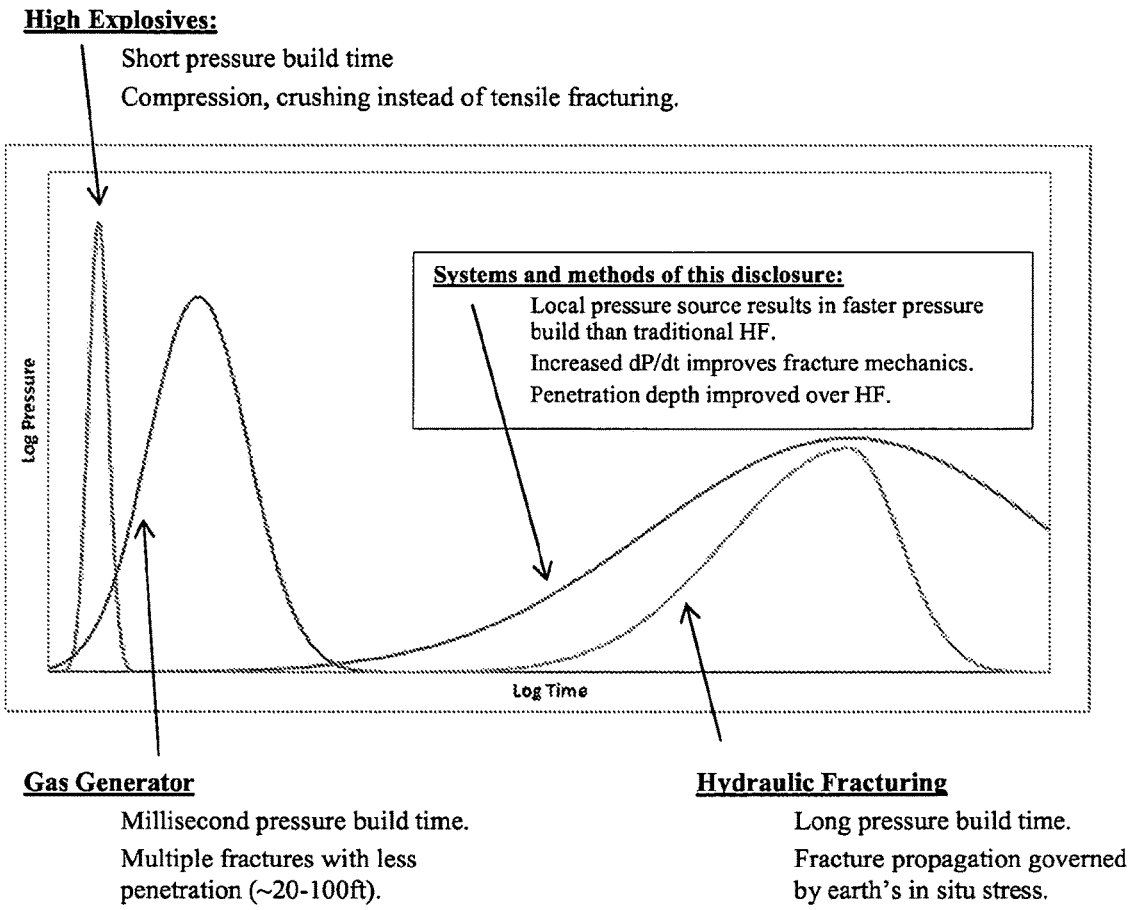
FIG. 2 is a graph depicting pressure in a geologic structure versus time for various systems and methods of fracturing, including some embodiments of present systems and methods.

It may be appreciated that an advantage of the systems and methods described herein is an extended characteristic time for sensing activity of the corroding metals compared to conventional hydraulic fracturing, high explosives and/or gas generators as depicted in FIG. 2 The systems and methods described herein deliver localized pressure sources and the pressure gradient may build up significantly faster than conventional hydraulic fracturing, which may translate to a greater number of fractures in the source rock extended over a longer characteristic time period. Additionally, it should be appreciated that this is notably different as compared to high explosives or gas generators known in the art, which build pressures rapidly, however these pressures are unsustained over long time periods. The systems and methods described herein facilitate sustained and detectable pressure events which can be detected earlier than in a conventional fracturing process alone and because the pressure is sustained, these events can be detected long after the conventional hydraulic fracturing process.

In some embodiments, the methods described herein are performed simultaneously with a conventional hydraulic fracturing process and/or well-stimulating process described in the incorporated references. In other embodiments, the methods described herein are performed before or after a conventional hydraulic fracturing process and/or well-stimulating process described in the incorporated references.

Figure 3:
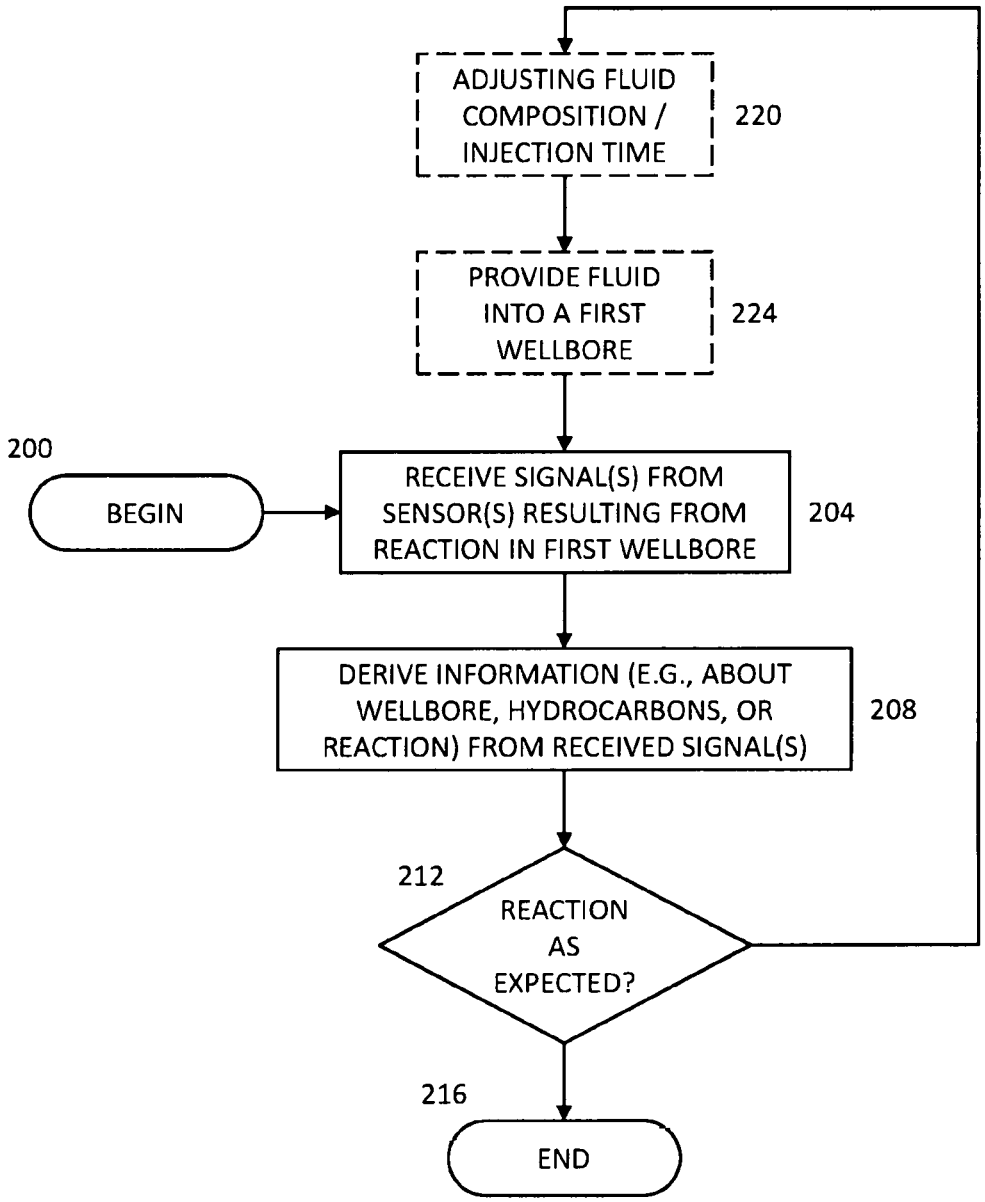
FIG. 3 is a flowchart depicting one embodiment of the present methods.

FIG. 3 is a flowchart depicting an embodiment of the present methods. In the embodiment shown, the method begins at 200 and proceeds to a step 204 at which a signal is received (at a monitoring unit such as, e.g., 130) from each of one or more sensors (e.g., 120*a*, 120*b*). In this embodiment, and as described above, each signal is indicative of a parameter related to electrochemical oxidation of a base metal and electrochemical reduction of a reducible species that generates a gaseous product in the wellbore (e.g., after at least some of the reducible species is introduced into the wellbore in a first fluid composition). In the depicted embodiment, the method then proceeds to a step 308 at which information is derive from the received signal(s). For example, information can be derived about the first wellbore, extraction of hydrocarbons from the first wellbore, and/or the reaction (e.g., the electrochemical reduction). In some embodiments, information can be deduced directly. For example, the existence of a reaction can be directly confirmed by the detection of the gaseous byproduct (e.g., hydrogen) with a chemistry sensor.

In some embodiments, information can also be derived by comparing measured parameters with expected parameters. For example, in the embodiment shown, the method proceeds to a step 212 in which the monitoring unit compares measured parameters with expected ones. For example, pressure rising more slowly than expected can be indicative of an area in the well having a higher porosity than expected, a lower fracture threshold than expected, and/or a greater concentration of a base metal in the wellbore than expected. If the reaction proceeds as expected, the method can terminate at 216.

In some embodiments, such as the one shown, the method includes deriving information about the reaction both by direct measurement of parameters relevant to the reaction and by comparison of measured parameters with expected values of parameters for a planned reaction. For example, some embodiments comprise detecting the presence of a gaseous byproduct (e.g., hydrogen) and detecting pressure over time. In this example, if the gaseous byproduct is detected and the measured pressure rises to an effective level (e.g., above a fracture threshold for the formation being fractured or a relevant zone of the formation being fractured) the satisfaction of both criteria may indicate that the formation or zone thereof has been successfully fractured. In some instances, the fracture threshold of the formation may not be known in advance, and may instead be determined from changes in the measured pressure. For example, as the reaction proceeds, pressure will typically rise with the production of gaseous byproduct until the pressure exceeds a fracture threshold of at least the relevant part of the formation, at which point fractures will begin to form and—as they do—the pressure will decrease as the fluid flows outward into the newly-formed fractures. The identification of such a pattern, and the peak pressure in this pattern, indicate the existence and value, respectively, of the formation fracture threshold pressure.

If the comparison at step 212 reveals that the reaction has not proceeded as expected, the method can comprise adjusting the reaction and/or initiating a new reaction. For example, in the depicted embodiment, the method proceeds to a step 220 at which the fluid composition and/or the time (and therefore volume) of fluid injection is adjusted. The fluid composition can be adjusted in any of various ways, including for example, adjusting the pH of the fluid composition, adjusting the concentration of the base metal in the fluid composition, adjusting the concentration of the reducible species in the fluid composition, and/or the like. If, at the time the discrepancy is identified, the reaction is already completed or has sufficiently progressed that it cannot be adjusted, a second reaction can be initiated.

Whether adjusting the composition of a fluid that is already been injected or one that has not yet begun to be injected (e.g., a second fluid to initiated a further reaction), the depicted embodiment can continue with or proceed to a step 224 at which the fluid is injected into the wellbore. A reaction can either continue or begin anew, and the process may continue as appropriate until terminated at 216.

The above specification and examples provide a complete description of the structure and use of illustrative embodiments. Although certain embodiments have been described above with a certain degree of particularity, or with reference to one or more individual embodiments, those skilled in the art could make numerous alterations to the disclosed embodiments without departing from the scope of this invention. As such, the various illustrative embodiments of the methods and systems are not intended to be limited to the particular forms disclosed. Rather, they include all modifications and alternatives falling within the scope of the claims, and embodiments other than the one shown may include some or all of the features of the depicted embodiment. For example, elements may be omitted or combined as a unitary structure, and/or connections may be substituted. Further, where appropriate, aspects of any of the examples described above may be combined with aspects of any of the other examples described to form further examples having comparable or different properties and/or functions, and addressing the same or different problems. Similarly, it will be understood that the benefits and advantages described above may relate to one embodiment or may relate to several embodiments.

The claims are not intended to include, and should not be interpreted to include, means-plus- or step-plus-function limitations, unless such a limitation is explicitly recited in a given claim using the phrase(s) "means for" or "step for," respectively.

The invention claimed is:

1. A method for characterizing a first wellbore extending into a geologic structure comprising a reservoir of subterranean hydrocarbons, the method comprising:

providing a first fluid composition comprising a base metal into the first wellbore; wherein corrosion of the base metal in the first wellbore results in electrochemical oxidation of the base metal and electrochemical reduction of a reducible species that generates a gaseous product;

providing at least one sensor in proximity to the first wellbore;

receiving a signal from the sensor at a monitoring unit, wherein the sensor senses energy resulting from corrosion of the base metal, the energy being in the form of acoustic energy, electromagnetic energy, seismic energy, a derivative or a combination thereof, wherein the signal is indicative of the energy and is used to determine information relating to characteristics of at least one item selected from the group consisting of: the first wellbore, extraction of hydrocarbons from the first wellbore, and the electrochemical reduction; and adjusting the electrochemical reduction.

2. The method according to claim 1, wherein the reducible species is water and the gaseous product is hydrogen gas.

3. The method according to claim 1, wherein the derived information is selected from the group consisting of: a reservoir dimension/geometry, a fracture dimension/geometry, a wellbore dimension/geometry, an azimuth, ground deformation data, seismic activity data, concentration of connate water, concentration of base metal particles, a corrosion rate, reservoir drainage volume, stimulated fracture planes generated by a hydraulic fracturing process, stimulated reservoir volume (SRV) generated by a hydraulic fracturing process, a characteristic transport rates, a characteristic relaxation time period, a derivative thereof, and/or a combination thereof.

4. The method according to claim 1, further comprising determining the information relating to the characteristics of the at least one item based on a corrosion rate.

5. The method according to claim 1, wherein each sensor provides information relating to changes in subsurface electrical properties, mechanical properties, or a combination thereof.

6. The method according to claim 1, wherein the at least one sensor comprise an accelerometer, a microphone, a geophone for converting ground movement into a voltage signal, a pressure sensor, or a combination thereof.

7. The method according to claim 1, wherein the sensor is provided at the ground surface of the geologic structure, in a second wellbore proximal to the first wellbore, in the first wellbore or a combination thereof.

8. The method according to claim 1, wherein the sensing occurs simultaneously with a hydraulic fracturing process in the first wellbore.

9. The method according to any of claim 1, wherein the sensing occurs subsequent to a hydraulic fracturing process in the first wellbore.

10. The method according to claim 1, wherein the information about the characteristics of the at least one item is further derived based on a corrosion rate of the base metal, concentration of base metal particles, or both.

11. The method according to claim 10, where adjusting the chemical reduction comprises changing at least one parameter selected from the group consisting of: pH of fluid in the first wellbore, concentration of the base metal in the fluid in the first wellbore, concentration of the reducible species in fluid in the first wellbore.

12. The method according to claim 1, further comprising the step of injecting a second fluid composition differing from the first fluid composition, and wherein the second fluid composition is selected to adjust the electrochemical reduction.

13. The method according to claim 1, further comprising the step of injecting a second fluid composition differing from the first fluid composition, and wherein the second fluid composition initiates a second electrochemical reduction.

14. A method for characterizing a first wellbore extending into a geologic structure comprising a reservoir of subterranean hydrocarbons, the method comprising:

receiving a signal from each of one or more sensors, wherein each sensor of the one or more sensors senses energy resulting from the corroding metal, the energy being in the form of acoustic energy, electromagnetic energy, seismic energy, a derivative or a combination thereof, each signal indicative of a parameter related to electrochemical oxidation of a base metal and electrochemical reduction of a reducible species that generates a gaseous product in the wellbore, at least some of the reducible species introduced into the wellbore in a first fluid composition; and deriving, from at least the signal, information about characteristics of at least one item selected from the group consisting of: the first wellbore, extraction of hydrocarbons from the first wellbore, and the electrochemical reduction, where each sensor is disposed in a position selected from the group consisting of: a first wellbore, in a second wellbore close enough to the first wellbore that the sensor can detect its respective parameter, or at the ground surface of the geologic structure; and adjusting the electrochemical reduction.

15. The method according to claim 14, further comprising the step of injecting a fluid composition comprising a metal differing from that of the first fluid composition, thereby providing a galvanic corrosion couple upon contact of the differing metals.

16. The method according to claim 14, further comprising the steps of sequentially injecting alternate stages of fluid compositions into the first wellbore, the stages being selected from the group consisting of:

injecting a fluid composition comprising base metal particles into the wellbore for a first predetermined time period;

injecting a second fluid composition comprising an activating additive into the wellbore for a second predetermined time period, wherein the activating additive activates the corrosion process; and injecting a third fluid composition comprising a deactivating additive for a third predetermined time period, wherein the deactivating additive deactivates the corrosion process, wherein an alternating signal resulting from the alternating stages provides a characteristic frequency detected by a sensor; and wherein the signal is used to determine information relating to the characteristics of the first wellbore and extraction of hydrocarbons therefrom.

17. The method of claim 16, further comprising adjusting the second fluid composition based on the derived information.

18. The method of claim 17, where adjusting the second fluid composition comprises adjusting a concentration of the activating agent or adjusting the length of the second predetermined time period.

19. The method according to claim 16, wherein the second fluid composition and the third fluid composition are injected in an alternating sequence to produce an electrochemical reaction alternating in a frequency related to the second predetermined time period and the third predetermined time period.

20. The method of claim 19, wherein the sequence is terminated based on the derived information.

21. The method according to claim 16, further comprising an idle stage wherein the corrosion process proceeds in the absence of reservoir stimulation until reaching a predetermined time period, a predetermined pressure, a predetermined signal characteristic, a user command or a combination thereof.

22. A method for characterizing a first well bore extending into a geologic structure comprising a reservoir of subterranean hydrocarbons, the method comprising:

providing a first fluid composition comprising a base metal into the first wellbore; wherein corrosion of the base metal in the first wellbore results in electrochemical oxidation of the base metal and electrochemical reduction of a reducible species that generates a gaseous product;

providing at least one sensor in proximity to the first wellbore;

receiving a signal from the sensor at a monitoring unit, wherein the sensor senses energy resulting from corrosion of the base metal, the energy being in the form of acoustic energy, electromagnetic energy, seismic energy, a derivative or a combination thereof, wherein the signal is indicative of the energy and is used to determine information relating to characteristics of at least one item selected from the group consisting of: the first wellbore, extraction of hydrocarbons from the first wellbore, and the electrochemical reduction; and injecting a second fluid composition differing from the first fluid composition.

* * * * *